United States Patent [19]

Schmitt

[11] 4,035,756

[45] July 12, 1977

[54] TWO TEMPERATURE THERMOSTAT

[75] Inventor: Donald J. Schmitt, Mansfield, Ohio

[73] Assignee: Therm-O-Disc Incorporated, Mansfield, Ohio

[21] Appl. No.: 652,233

[22] Filed: Jan. 26, 1976

[51] Int. Cl.[2] ..... H01H 37/52

[52] U.S. Cl. ..... 337/370; 337/95

[58] Field of Search ..... 337/370, 369, 372, 371, 337/362, 363, 378, 380, 381, 95, 96, 354, 343; 73/363.1

[56] References Cited

U.S. PATENT DOCUMENTS

| | | | |
|---|---|---|---|
| 3,500,277 | 3/1970 | Nardulli | 337/343 |
| 3,878,499 | 4/1975 | Concin | 337/380 |

*Primary Examiner*—Harold Broome

*Attorney, Agent, or Firm*—McNenny, Pearne, Gordon, Gail, Dickinson & Schiller

[57] ABSTRACT

A dual temperature thermostat is disclosed in which two bimetal snap discs are connected to separately operate two switch mechanisms. The snap discs are retained in separate, generally concentric disc seats formed in a retainer cup. The body is provided with first abutment surfaces to maintain the inner disc in its seat and a plurality of symmetrically positioned projections which extend through openings in the inner disc and provide abutments which engage the outer disc and maintain it in its seat. The abutments and the seats are proportioned so that the two discs cannot contact each other during their operation.

4 Claims, 2 Drawing Figures

TWO TEMPERATURE THERMOSTAT

BACKGROUND OF THE INVENTION

This invention relates generally to bimetal snap disc thermostat and more particularly to a novel and improved device of such type in which two separate discs operate at two different temperatures to provide a dual temperature thermostat.

PRIOR ART

Dual temperature bimetal snap disc thermostats are known. Examples of such devices are illustrated in the U.S. Letters Pat. No. 3,500,277 issued Mar. 10, 1970, the British Pat. No. 1,214,252 published Dec. 2, 1970, and the copending application for U.S. Letters Pat., Ser. No. 533,925 filed Dec. 18, 1974 now U.S. Pat. No. 3,943,380. Such application is assigned to the assignee of the present invention.

Each of these patents discloses a dual temperature thermostat having two switches and two bimetal snap discs. Separate bumpers extend between the associated snap discs and switches so that each switch is operated independently of the other switch.

SUMMARY OF THE INVENTION

The present invention provides a dual temperature bimetal snap disc thermostat in which novel and improved means are provided to insure the proper positioning of the separate snap discs within the device. Such means prevents the disc from moving out of their respective seats and also maintains a spacing between the two discs to insure that the operation of one disc does not affect the operation of the other disc.

In the illustrated thermostat, two discs are positively positioned by a disc cup and a molded switch body. The disc cup is formed with two disc seats with the outer seat smaller than the inner seat. An outer disc is positioned in the outer seat and a larger diameter inner disc is mounted in the inner seat. The body is formed with a shoulder abutment which maintains the inner disc in its seat. The body also includes a plurality of projections which extend through apertures in the inner disc to end abutments which operate to maintain the outer disc in its seat. The proportions are arranged so that the two discs cannot shake or otherwise move out of their respective seats and so that the two discs are positively separated. Consequently, the two discs are maintained in their proper position and the operation of one disc cannot affect the operation of the other disc.

DETAILED DESCRIPTION OF THE DRAWINGS

Figure 1:
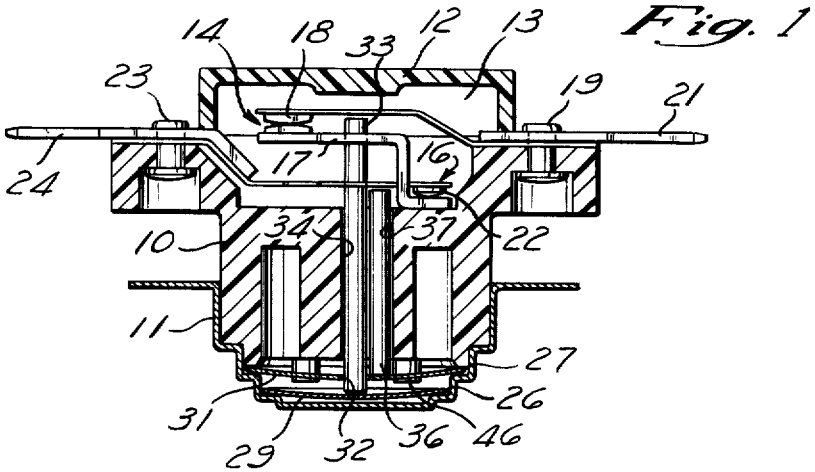
FIG. 1 is a side elevation generally in longitudinal section illustrating a dual temperature thermostat incorporating the present invention; and, FIG. 2 is an enlarged exploded fragmentary perspective view of the disc portion of the thermostat of FIG. 1, illustrating the structural detail thereof.

In the prior art patents cited above, dual temperature thermostats are provided with a disc cup formed with two generally concentric disc seats with the outer disc seat having a smaller diameter than the inner disc seat. In each such device, a bimetal snap disc is positioned against each of the seats and the inner disc is formed with an aperture through which a bumper projects to operatively connect the outer disc to its associated switch. In such devices, the outer disc is retained in its disc seat only by the associated bumper and associated switch mechanism. In devices of such general type, it is possible in some instances for the outer disc to vibrate or work its way out of its associated seat so that it extends under the edge of the inner disc in such a way that a malfunction can occur. Further, in some instances, the rather severe movement which occurs when a bimetal snap disc operates can cause one disc to engage the other disc and cause momentary operation of the switch associated with such other disc.

In accordance with the present invention, positive means are provided to insure that the two discs each remain properly positioned with respect to their seats and so that the operation of one disc cannot affect the operation of the other disc.

Referring to the drawings, the illustrated embodiment of this invention includes a main body member 10 and a cover member 12, both preferably molded of phenolic resin or the like, and a drawn metal disc retaining cup 11 which cooperate to provide a body assembly. The body 10 and cover 12 define a switch chamber 13 in which two switches 14 and 16 are located. In the illustrated embodiment, the two switches 14 and 16 are connected in series and are provided with a single fixed contact member 17. It should be understood, however, that the invention may be incorporated in devices in which the two switches are electrically independent. A first movable contact 18 is cantilever mounted by a rivet 19 on the body 10 and is connected to a terminal 21. A second movable contact 22 is mounted on the body 10 by a rivet 23 and is electrically connected to a terminal 24.

The disc retaining cup 11 is formed with an outer seat 26 and an inner seat 27 having a larger diameter than the outer seat 26. Each seat consists of a lateral wall operable to engage one side of a bimetal snap disc adjacent to its periphery and a cylindrical axially extending wall which radially locates the associated disc. In the illustrated embodiment, the two disc seats 26 and 27 are coaxial or concentric. However, in accordance with the broader aspects of this invention, it is equally applicable to arrangements in which the two disc seats are arranged so that the outer disc seat 26 is not precisely concentric with the inner disc seat 27.

Positioned in the outer disc seat 26 is an outer bimetal snap disc 29, which is operable to snap between two positions of stability upon reaching predetermined operating temperatures. Positioned against the inner disc seat 27 is the second or inner bimetal snap disc 31, which is also operable in response to changes in temperatures to snap between two positions of stability. The inner disc 31 has a larger diameter than the outer disc 29 and is formed with a central aperture 32 through which a first bumper 33 extends. The bumper 33 is guided within a bore 34 within the body 10 for axial movement and extends from the central portion of the outer disc 29 to the movable contact 18 so that when the outer snap disc 29 operates, the first switch 14 is opened and closed. Preferably, the first bumper 33 is sized so that a small clearance exists so that lost motion is provided to insure that the disc 29 is in full snap movement before the switch 14 opens. The movable contact 16 is formed with an aperture to receive the first bumper 33 with clearance.

A second bumper 36 is positioned within a bore 37 in the body 10 for axial movement and operates the switch 16 in response to snap movement of the inner disc 31. Here again, the second bumper 36 is preferably sized to provide lost motion to insure that the switch 16 is opened only after the inner disc 31 is in snap movement.

It is customary to form the two discs 29 and 31 so that they operate at different temperatures. In the illustrated device in which the first and second switches 14 and 16 are connected in series, one of the discs is usually selected to operate at the desired operating temperatures of the system controlled by the thermostat and the other disc is selected to operate at a higher temperature, normally not encountered, and functions as a high limit to protect the controlled system in the event of malfunction of some nature which produces excessive temperatures in the system.

Figure 2:
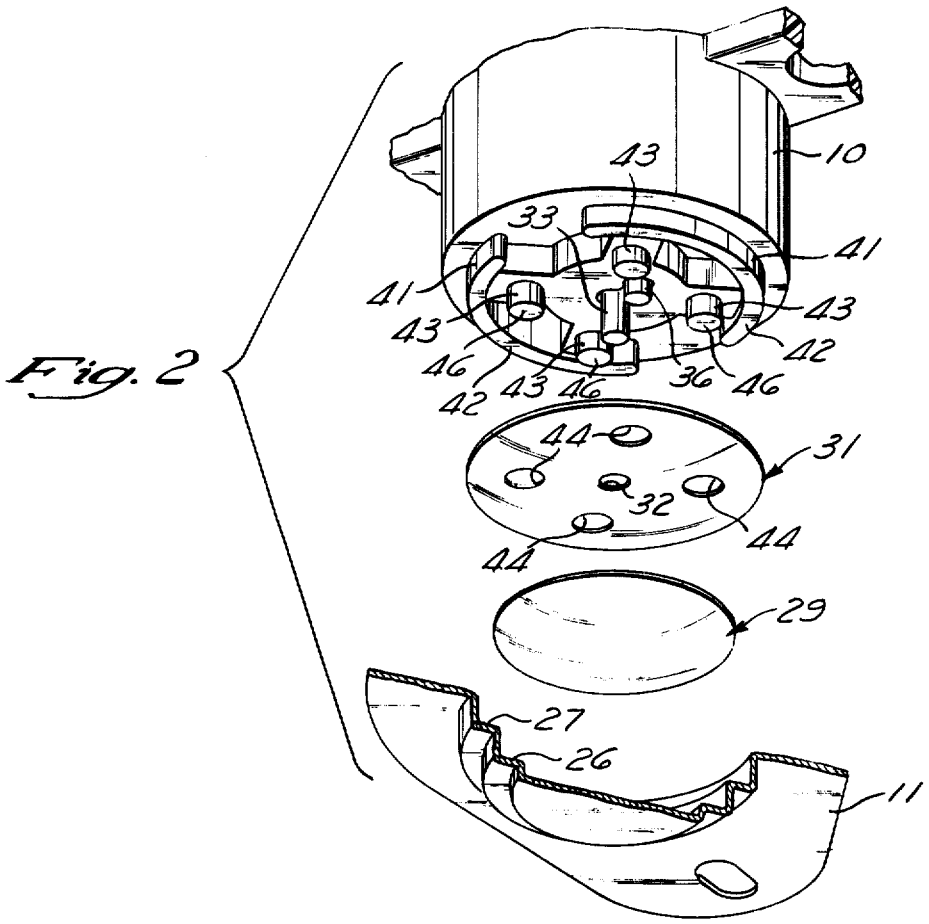

Referring to FIG. 2, the body 10 is formed with arcuate projections 41 having end faces 42, or abutments, which are located when the device is assembled to engage the periphery of the inner disc 31 on the side opposite the seat 27 to loosely retain the inner disc 31 in position within the seat. Here again, axial clearance is usually provided to insure that the periphery of the inner disc is not tightly gripped, since such tight gripping tends to alter disc operating temperatures. Such clearance, however is sufficiently small to insure that the disc remains properly in the disc seat.

The body 10 is also formed with four generally cylindrical projections 43, which project through clearance apertures or openings 44 in the inner disc 31 and provide end surfaces 46 or abutments, which are located to engage the upper surface of the outer disc 29 to positively maintain the outer disc 29 in its associated seat 26. In the illustrated embodiment, the projections 43 and end surfaces 46 are spaced from the center line of the device a distance substantially equal to the radius of the outer disc 29 so that they operate to engage the outer disc 29 substantially at its periphery. Here again, sufficient clearance is provided between the end surfaces 46 and the upper inner surface of the outer disc 29 to insure that the disc 29 is free to snap back and forth without restraint which could change the calibration temperature of the disc. However, the proportions are arranged so that the outer disc 29 is maintained within its associated seat 26 and preferably arranged so that the outer disc 29 cannot engage the inner disc 31 under any circumstance.

In the illustrated embodiment in which the outer disc 29 is the disc which cycles back and forth to provide normal operating control, its associated switch 14 is provided with contacts capable of repeated operation. On the other hand, the inner disc 31 is intended to provide high limit protection and does not operate repeatedly. Consequently, the associated switch 16 is not provided with contacts which can withstand large numbers of operating cycles. Consequently, if the device were constructed so that the operation of the outer disc 29 could cause it to engage the inner disc 31 and cause the switch 16 to momentarily open, failure of the switch 16 could occur. However, in the illustrated device, the projections 43 engage the outer disc 29 at symmetrically spaced locations to insure that it cannot engage the inner disc 31 and cannot cause undesired momentary operation of the switch 16.

In accordance with the present invention, a simple, low-cost structure is provided which insures reliable operation in a dual temperature device without extra parts or increased costs. Consequently, a low-cost, reliable device is provided.

Although a preferred embodiment of this invention is illustrated, it is to be understood that various modifications and rearrangements may be resorted to without departing from the scope of the invention disclosed and claimed.

What is claimed is:

1. A thermostat comprising a body assembly including a body member and disc retainer member, said retainer member providing inner and outer generally concentric disc seats with said inner seat larger than said outer seat, a pair of switches in said body assembly, an outer bimetal snap disc seated in said outer seat, first motion transmitting means operable to operate one of said switches in response to movement of said outer disc, an inner bimetal snap disc seated in said inner seat, second motion transmitting means operable to operate the other of said switches in response to movement of said inner disc, said body member providing first abutment surfaces operable to engage said inner disc and retain it in said inner seat and second abutment surfaces operable to engage said outer disc and retain it in said outer seat.

2. A thermostat as set forth in claim 1 wherein said inner disc is formed with apertures, and said second abutment surfaces are provided by projections on said body member which extend through said apertures.

3. A thermostat as set forth in claim 2 wherein said first and second seats and said second abutment surface are proportioned and located so that said discs cannot contact each other.

4. A thermostat as set forth in claim 1 wherein said first and second seats and said second abutment surface are proportioned and located so that said discs cannot contact each other.

* * * * *